US011119450B2

(12) United States Patent
Mitani

(10) Patent No.: US 11,119,450 B2
(45) Date of Patent: Sep. 14, 2021

(54) ELECTRONIC TIMEPIECE

(71) Applicant: Seiko Epson Corporation, Tokyo (JP)

(72) Inventor: Toshihiro Mitani, Matsumoto (JP)

(73) Assignee: Seiko Epson Corporation

( * ) Notice: Subject to any disclaimer, the term of this patent is extended or adjusted under 35 U.S.C. 154(b) by 391 days.

(21) Appl. No.: 16/281,379

(22) Filed: Feb. 21, 2019

(65) Prior Publication Data

US 2019/0258209 A1 Aug. 22, 2019

(30) Foreign Application Priority Data

Feb. 22, 2018 (JP) ..... JP2018-029745

(51) Int. Cl.

| | |
|---|---|
| ***G04R 60/10*** | (2013.01) |
| ***G04C 10/00*** | (2006.01) |
| ***G04R 20/02*** | (2013.01) |
| ***H01Q 1/27*** | (2006.01) |
| ***G04B 37/00*** | (2006.01) |
| ***G04G 17/04*** | (2006.01) |

(52) U.S. Cl.

CPC ..... *G04R 60/10* (2013.01); *G04B 37/0008* (2013.01); *G04C 10/00* (2013.01); *G04G 17/04* (2013.01); *G04R 20/02* (2013.01); *H01Q 1/273* (2013.01)

(58) Field of Classification Search

CPC ..... G04R 60/10; G04R 20/02; G04R 60/12; G04R 21/04; G04B 37/0008; G04C 10/00; G04C 9/08; G04C 9/02; G04G 17/04; G04G 5/002; H01Q 1/273

USPC ..... 368/204

See application file for complete search history.

(56) References Cited

U.S. PATENT DOCUMENTS

| | | | | |
|---|---|---|---|---|
| 6,853,605 | B2 * | 2/2005 | Fujisawa | G07C 9/28 368/10 |
| 8,467,272 | B2 * | 6/2013 | Fujisawa | G04C 10/02 368/47 |
| 10,761,491 | B2 * | 9/2020 | Yamamoto | G04G 17/06 |
| 2016/0161920 | A1 | 6/2016 | Fujisawa et al. | |

FOREIGN PATENT DOCUMENTS

JP 2016-109522 A 6/2016

* cited by examiner

*Primary Examiner* — Edwin A. Leon

(74) *Attorney, Agent, or Firm* — Harness, Dickey & Pierce, P.L.C.

(57) ABSTRACT

An electronic timepiece includes a dial, an indicating hand shaft passing through the dial and to which an hour hand is attached, a planar antenna overlapping a 12-o'clock line, a winding stem overlapping a 3-o'clock line, a battery disposed in a region bordered by a 9-o'clock to 3-o'clock line and including the 6-o'clock position on the dial, and a first motor driving a second hand, a second motor driving a minute hand, and a third motor driving the hour hand. The planar antenna, the winding stem, the battery, the first motor, the second motor, and the third motor do not overlap one another in a plan view, and one of the first, second, and third motor is disposed between the planar antenna and the winding stem.

20 Claims, 5 Drawing Sheets

ELECTRONIC TIMEPIECE

BACKGROUND

1. Technical Field

The present invention relates to an electronic timepiece, and particularly to an electronic timepiece including a planar antenna and a plurality of motors.

2. Related Art

As an electronic timepiece including a planar antenna that receives electric waves transmitted from a position information satellite, such as the GPS (global positioning system), there is a known electronic timepiece that can ensure satisfactory reception performance and is reduced in thickness (JP-A-2016-109522).

The electronic timepiece described above includes a time display section including a dial, which is formed of a non-electrically-conductive member, and indicating hands, a planar antenna, motors that drive the indicating hands, and a battery. The planar antenna, the motors, and the battery are located so as to each overlap with the time display section but to not overlap with one another in a plan view. The thickness of the electronic timepiece can therefore be reduced as compared with a case where the planar antenna, the motors, and the battery overlap with one another in the thickness direction of the timepiece. Further, since the planar antenna can be disposed so as to not overlap with the motors or the battery in the plan view, a planar antenna formed of a laminate of dielectric elements and therefore having a small planar size can be used with satisfactory reception performance ensured.

In the electronic timepiece described in JP-A-2016-109522, in which the planar antenna is disposed in a five-o'clock position on the dial in the plan view, the arrangement of the planar antenna restricts the position of each sub-dial and the number thereof. Therefore, the exterior appearance of the dial of the timepiece is restricted, and incorporation of a function using a sub-dial is also restricted, resulting in a problem of a difficulty in expanding the applications of the electronic timepiece to products having small thicknesses, assorted exterior appearances, and multiple functions.

SUMMARY

An advantage of some aspects of the invention is to provide an electronic timepiece that allows expansion of the applications thereof to products having small thicknesses, assorted exterior appearances, and multiple functions.

An electronic timepiece according to an aspect of the invention includes a dial, an indicating hand shaft which passes through the dial and to which an hour hand is attached, a planar antenna located so as to overlap with a 12-o'clock imaginary line that connects the indicating hand shaft to a 12-o'clock position in a plan view, a winding stem located so as to overlap with a 3-o'clock imaginary line that connects the indicating hand shaft to a 3-o'clock position in the plan view, a battery disposed in only in one of two regions into which a region that coincides with the dial in the plan view is divided by a 9-o'clock imaginary line that connects the indicating hand shaft to a 9-o'clock position and the 3-o'clock imaginary line, and includes a 6-o'clock position on the dial, and a first motor that drives a second hand, a second motor that drives a minute hand, and a third motor that drives the hour hand. The planar antenna, the winding stem, the battery, the first motor, the second motor, and the third motor are located so as to not overlap with one another in the plan view, and one of the first motor, the second motor, and the third motor is disposed between the planar antenna and the winding stem.

According to the aspect of the invention, the planar antenna is disposed on the 12-o'clock side and the winding stem is disposed on the 3-o'clock side in the plan view with respect to the indicting hand shaft, which passes through the dial and to which the hour hand is attached. The battery is disposed in one of the two regions overlapped with the dial into which the region that coincides with the dial in the plan view is divided by the 3-o'clock imaginary line and the 9-o'clock imaginary line, that is, in the 6-o'clock-side region. The planar antenna, the winding stem, and the battery can therefore be disposed in a distributed manner, and the first to third motors can also be readily located so as to not overlap with these parts. The thickness of the electronic timepiece can therefore be reduced because each part having a relatively large thickness are disposed so as to not overlap with one another in the thickness direction of the electronic timepiece.

Further, since one of the first to third motors, which drive the hour hand, the minute hand, and the second hand, is disposed between the planar antenna and the winding stem, a relatively narrow space between the planar antenna and the winding stem can be effectively used. Moreover, the space where the remaining two motors can be disposed is increased, whereby the other motors for sub-dials can be readily disposed. Therefore, in a case where sub-dials are provided, the sub-dials can be disposed with increased flexibility, whereby assorted exterior appearances of the electronic timepiece can be achieved. Further, the applications of the electronic timepiece can be readily expanded to products having multiple function using sub-dials, such as a chronograph function and dual time display.

In the electronic timepiece according to the aspect of the invention, it is preferable that one of the first motor, the second motor, and the third motor is disposed between the indicating hand shaft and the winding stem in the plan view.

According to the aspect of the invention with this configuration, in which one of the first to third motors is disposed between the indicating hand shaft and the winding stem in the plan view, the motors and the winding stem can be arranged in the radial directions of the dial, whereby the space that coincides with the dial in the plan view can be efficiently used.

That is, since any one of the first to third motors can be disposed between the planar antenna and the winding stem, and another can be disposed in a central portion of the dial shifted from the winding stem, the space where the remaining motor can be disposed is increased, whereby the other motors for sub-dials can be readily disposed.

In the electronic timepiece according to the aspect of the invention, it is preferable that one of the first motor, the second motor, and the third motor is disposed between the planar antenna and the battery in the plan view.

According to the aspect of the invention with this configuration, in which one of the first to third motors is disposed between the planar antenna and the battery in the plan view, the relatively narrow region between the planar antenna and the battery can be effectively used.

That is, since any one of the first to third motors can be disposed between the planar antenna and the winding stem, and another can be disposed between the planar antenna and the battery, the space where the remaining motor can be disposed is increased, whereby the other motors for sub-dials can be readily disposed.

In the electronic timepiece according to the aspect of the invention, it is preferable that the motor disposed between the planar antenna and the winding stem is the third motor.

According to the aspect of the invention with this configuration, the third motor, which drives the hour hand, can be disposed between the planar antenna and the winding stem. The hour hand moves at an interval longer than intervals at which the second hand and the minute hand move. Therefore, as compared with a case where the first and second motors are located so as to be close to the planar antenna, disposing the third motor in a position close to the planar antenna allows reduction in the effect of the disposed motor on the reception performed by the planar antenna.

In the electronic timepiece according to the aspect of the invention, it is preferable that a fourth motor is disposed between the battery and the winding stem, and that the fourth motor drives an indicating hand attached to a second indicating hand shaft provided in a position shifted from the indicating hand shaft in a 6-o'clock direction.

According to the aspect of the invention with this configuration, in which the fourth motor is disposed between the battery and the winding stem, the space between the battery and the winding stem can be effectively used.

Further, since the fourth motor can be disposed in a position close to the indicating hand attached to the second indicating hand shaft provided in a position shifted from the indicating hand shaft in the 6-o'clock direction, that is, the indicating hand in a sub-dial, the number of gears in a wheel train that drives the indicating hand can be reduced, whereby the fourth motor and the wheel train can be readily laid out.

In the electronic timepiece according to the aspect of the invention, it is preferable that one of the first motor, the second motor, and the third motor and a fifth motor are disposed between the planar antenna and the winding stem, and that the fifth motor drives an indicating hand attached to a third indicating hand shaft provided in a range from a 3-o'clock direction to a 2-o'clock direction with respect to the indicating hand shaft.

According to the aspect of the invention with this configuration, in which the fifth motor is disposed between the planar antenna and the winding stem, the space between the planar antenna and the winding stem can be further effectively used.

Further, since the fifth motor can be disposed in a position close to the indicating hand attached to the third indicating hand shaft provided in the range from the 3-o'clock direction to the 2-o'clock direction with respect to the indicating hand shaft, that is, the indicating hand in a sub-dial, the number of gears in a wheel train that drives the indicating hand can be reduced, whereby the fifth motor and the wheel train can be readily laid out.

In the electronic timepiece according to the aspect of the invention, it is preferable that a sixth motor is disposed between the planar antenna and the 9-o'clock imaginary line, and that the sixth motor drives an indicating hand attached to a fourth indicating hand shaft provided in a range from a 9-o'clock direction to a 10-o'clock direction with respect to the indicating hand shaft.

According to the aspect of the invention with this configuration, in which the sixth motor is disposed between the planar antenna and the 9-o'clock imaginary line, the space between the planar antenna and the 9-o'clock imaginary line can be effectively used.

Further, since the sixth motor can be disposed in a position close to the indicating hand attached to the fourth indicating hand shaft provided in the range from the 9-o'clock direction to the 10-o'clock direction with respect to the indicating hand shaft, that is, the indicating hand in a sub-dial, the number of gears in a wheel train that drives the indicating hand can be reduced, whereby the sixth motor and the wheel train can be readily laid out.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Electronic Timepiece

Figure 1:
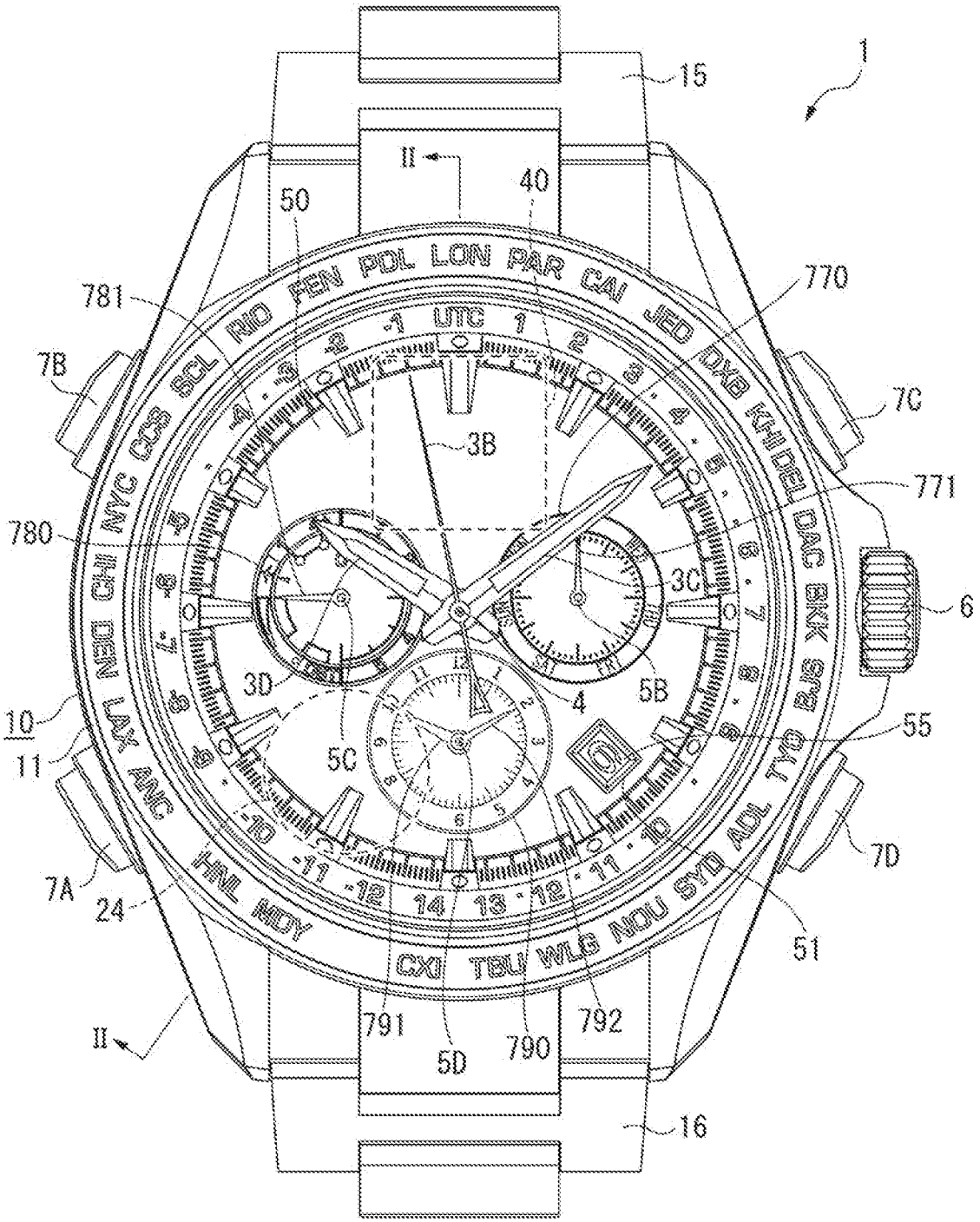
FIG. 1 is a front view showing a first electronic timepiece.
Figure 3:
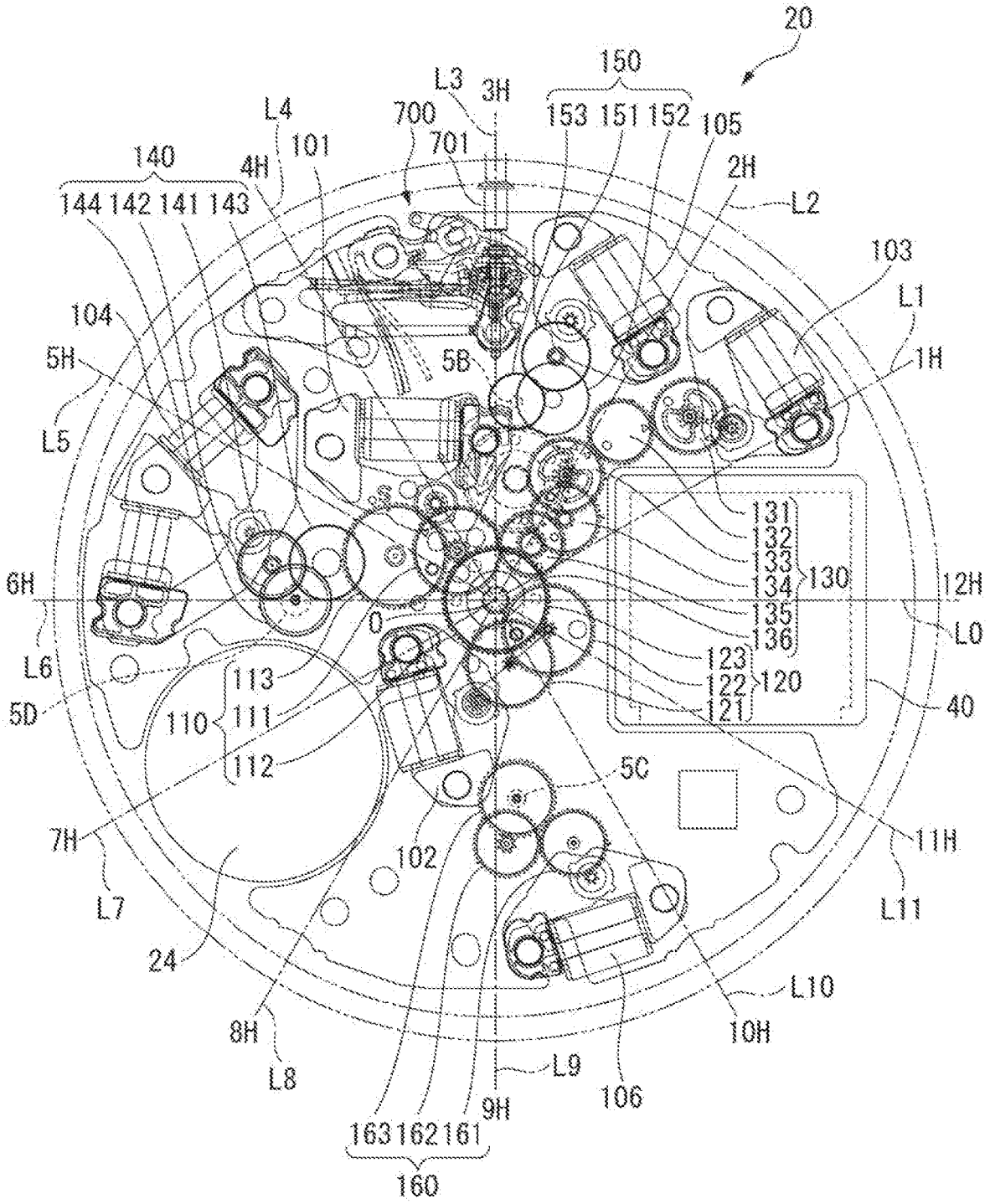
FIG. 3 is a plan view showing a movement of the first electronic timepiece.
Figure 4:
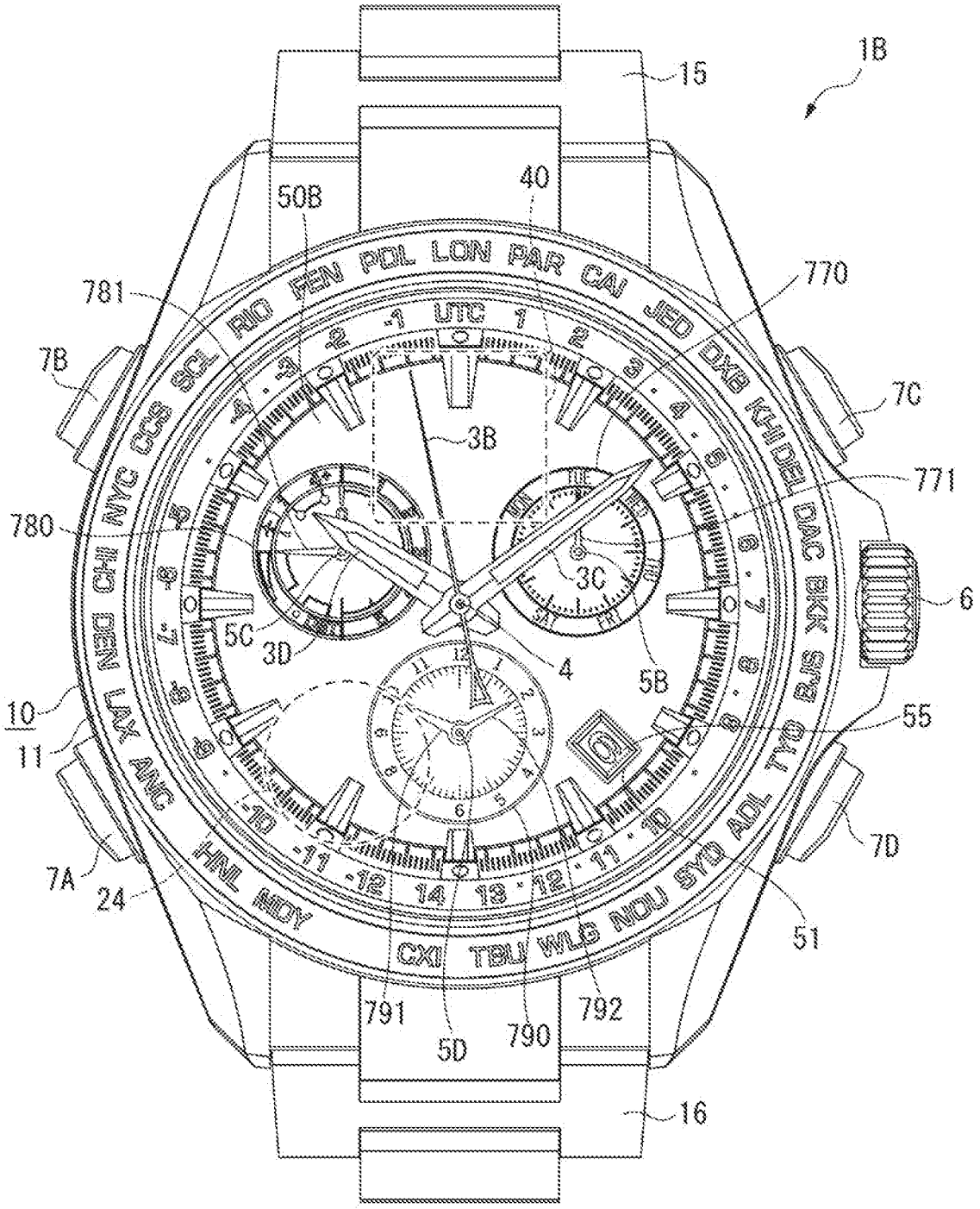
FIG. 4 is a front view showing a second electronic timepiece.

An embodiment of the invention relates to an electronic timepiece that allows a first electronic timepiece 1 shown in FIG. 1 and a second electronic timepiece 1B shown in FIG. 4 to be achieved. The electronic timepieces 1 and 1B differ from each other with respect to the positions of small windows (sub-dials) 770 and 780 and are the same with respect to their remaining configurations. The electronic timepiece 1 will therefore be first described with reference to FIGS. 1 to 3, and the electronic timepiece 1B will then be described primarily regarding the difference from the electronic timepiece 1 with reference to FIGS. 4 and 5.

In the following description, viewing the electronic timepieces 1 and 1B in the direction perpendicular to a dial and from the side facing a cover glass plate or a case back is referred to as a plan view.

The electronic timepieces 1 and 1B according to the present embodiment are each configured to be capable of receiving satellite signals from a plurality of position information satellites, such as GPS satellites and quasi-zenith satellites, which travel along predetermined orbits around the earth up in the sky and acquiring satellite time information from the satellite signals to correct internal time information. Further, the electronic timepieces 1 and 1B each have, as a satellite signal reception process, not only a manual reception function of starting the reception when a user operates a button but an automatic reception function of automatically starting the reception when a predetermined condition is satisfied.

Figure 2:
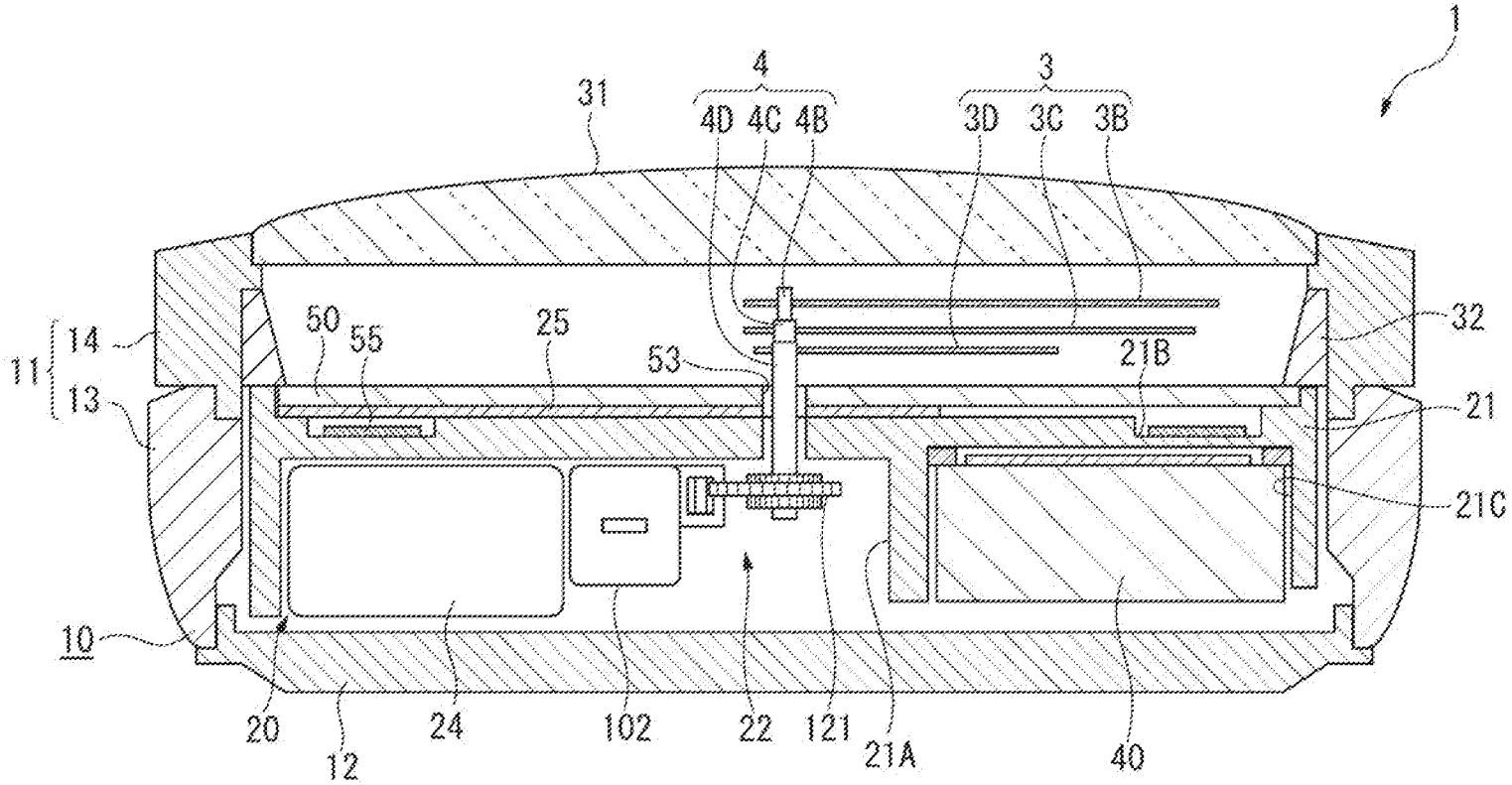
FIG. 2 is a cross-sectional view taken along the line II-II in FIG. 1.

The first electronic timepiece 1 includes an exterior case 10, which accommodates a dial 50, a movement 20, a planar antenna 40, a secondary battery 24, and other components, as shown in FIGS. 1 to 3. The electronic timepiece 1 further includes a crown 6 and four buttons 7A, 7B, 7C, and 7D, which are externally operated, and bands connected to the exterior case 10. The bands are formed of a first band 15, which is connected to the 12-o'clock side of the exterior case 10, a second band 16, which is connected to the 6-o'clock side of the exterior case 10, and a clasp that is not shown. The first band 15 and the second band 16 are each a metal band including an end piece made of titanium or any other metal and attached to the exterior case 10 and a plurality of small blocks. Each of the bands may not be limited to a metal band and may instead be a leather band or a resin band.

The dial 50 is formed of a non-electrically-conductive member made, for example, of polycarbonate, and formed in a disc-like shape. An indicating hand shaft 4 (second hand shaft 4B, minute hand shaft 4C, and hour hand shaft 4D), which is provided so as to pass through the dial 50, is disposed at a plane center O (FIG. 3) of the dial 50, and an indicating hand 3 (second hand 3B, minute hand 3C, and hour hand 3D) is attached to the indicating hand shaft 4.

The dial 50 has three small windows (sub-dials). That is, with respect to the plane center O of the dial 50, where the indicating hand shaft 4 is provided, a circular first small window 770 and an indicating hand 771 are provided in a 3-o'clock position, a circular second small window 780 and an indicating hand 781 are provided in a 9-o'clock position, and a circular third small window 790 and indicating hands 791 and 792 are provided in a 6-o'clock position, as shown in FIG. 1.

Further, a rectangular date window 51 is provided at a point in a direction between 4-o'clock and 5-o'clock directions (in 4.5-hour direction) with respect to the plane center O of the dial 50. A date indicator 55 is disposed on the side facing the rear surface of the dial 50, as also shown in FIG. 2, and the date indicator 55 is visually recognizable through the date window 51. Further, the dial 50 is further provided with a through hole 53, through which the indicating hand shaft 4 is inserted, and through holes (not shown) through which indicating hand shafts 5B, 5C, and 5D for the indicating hands 771, 781, 791, and 792 are inserted.

In the present embodiment, the indicating hand 771 in the first small window 770 is a day of the week hand indicating the day of the week, and the indicating hand 781 in the second small window 780 is a mode hand indicating a variety of pieces of information. The indicating hands 791 and 792 in the third small window 790 are an hour hand and a minute hand for a small timepiece that indicate home time and local time. The indicating hand 781, which is the mode hand, displays whether the daylight saving time is turned on or off (DST: daylight saving time ON, O: daylight saving time OFF), a power indicator indicating the amount of remaining power of the secondary battery 24, and the settings of the following modes: an airplane mode; a time measuring mode in which GPS time information is received and the internal time is corrected based on the GPS time information; and a position measuring mode in which GPS time information and orbit information are received and the internal time and the time zone are corrected based on the GPS time information and orbit information.

The secondhand 3B, the minute hand 3C, the hour hand 3D, the indicating hands 771, 781, 791, and 792, and the date indicator 55 are driven via motors and wheel trains that will be described later.

Exterior Structure of Electronic Timepiece

The electronic timepiece 1 includes the exterior case 10, which accommodates the movement 20, which will be described later, and other components, as shown in FIGS. 1 to 3. FIG. 2 is a cross-sectional view taken along the line II-II, which connects a 7-o'clock position on the dial 50, the plane center O of the dial 50, and a 12-o'clock position on the dial 50 to each other. FIG. 3 is a plan view of key parts of the movement 20 viewed from the side facing the case back.

The exterior case 10 includes a case body 11, a case back 12, and a cover glass plate 31, as shown in FIG. 2. The case body 11 includes a barrel 13, which has a cylindrical shape, and a bezel 14, which is provided on the front side of the barrel 13.

The case back 12, which has a disc-like shape and closes the rear-side opening of the case body 11, is provided on the rear side of the case body 11. The case back 12 is connected to the barrel 13 of the case body 11 with the aid of a screw structure. In the present embodiment, the barrel 13 and the case back 12 are separate from each other, but not necessarily, and the barrel 13 and the case back 12 may be integrated with each other into a one-piece case.

The barrel 13, the bezel 14, and the case back 12 are each made of a metal material, such as SUS (stainless steel), a titanium alloy, aluminum, and BS (brass).

Internal Structure of Electronic Timepiece

A built-in internal structure of the electronic timepiece 1 that is built in the exterior case 10 will be described next.

The exterior case 10 accommodates not only the dial 50 but the movement 20, the planar antenna (patch antenna) 40, the date indicator 55, a dial ring 32, and other components, as shown in FIG. 2.

The following description of the movement 20 will be made on the assumption that the case-back side of a main plate 21 is the front side and the dial side of the main plate 21 is the rear side.

The movement 20 includes the main plate 21, a train wheel bridge (not shown), a driver 22, which is supported by the main plate 21 and the train wheel bridge, a circuit substrate (not shown), the secondary battery 24, and a solar cell panel 25.

The main plate 21 is formed of a non-electrically-conductive member made, for example, of a plastic material. The main plate 21 includes a driver container 21A, which contains the driver 22, a date indicator placer 21B, where the date indicator 55 is placed, and an antenna container 21C, which contains the planar antenna 40. The date indicator placer 21B is formed of a ring-shaped recessed groove formed on the rear side of the main plate 21.

The driver container 21A and an antenna container 21C are provided on the front side of the main plate 21. The antenna container 21C is disposed in a position corresponding to 12-o'clock on the dial 50 in the plan view, and the planar antenna 40 is therefore disposed in a 12-o'clock position, as shown in FIGS. 1 and 3. Specifically, the planar antenna 40 is disposed between the indicating hand shaft 4 for the indicating hand 3 and the case body 11 and in a range from roughly the 11-o'clock position to roughly the 1-o'clock position on the dial 50. Therefore, in a case where a 12-o'clock imaginary line L0 extending from the plane center O of the dial 50 in the 12-o'clock direction, at least part of the planar antenna 40 overlaps with the 12-o'clock imaginary line L0, as shown in FIG. 3. Specifically, the plane center of the planar antenna 40 overlaps with the 12-o'clock imaginary line L0 in the plan view. The plan view in the description of FIGS. 3 and 5 means a state in which the movement 20 is viewed from the front side (side facing the case back 12).

In the following description, it is assumed that the line that connects the indicating hand shaft 4 (plane center O of dial 50) to the 12-o'clock position on the dial 50 is the 12-o'clock imaginary line L0 in the plan view and other imaginary lines that connect the indicating hand shaft 4 (plane center O) to the 1-o'clock to 11-o'clock positions on the dial 50 are defined respectively as follows: a 1-o'clock imaginary line L1; a 2-o'clock imaginary line L2; a 3-o'clock imaginary line L3; a 4-o'clock imaginary line L4; a 5-o'clock imaginary line L5; a 6-o'clock imaginary line L6; a 7-o'clock imaginary line L7; an 8-o'clock imaginary line L8; a 9-o'clock imaginary line L9; a 10-o'clock imaginary line L10; and an 11-o'clock imaginary line L11.

The secondary battery 24 is disposed in one of two regions into which the region that coincides with the dial 50 in the plan view is divided by the 3-o'clock imaginary line L3 and the 9-o'clock imaginary line L9, that is, in the region including the 6-o'clock position on the dial 50. Specifically, the secondary battery 24 is disposed in the region between the 6-o'clock imaginary line L6 and the 8-o'clock imaginary line L8, that is, a position where the secondary battery 24 overlaps with the 7-o'clock imaginary line L7.

The driver 22 is contained in the driver container 21A of the main plate 21 and drives the second hand 3B, the minute hand 3C, the hour hand 3D, the indicating hands 771, 781, 791, and 792, and the date indicator 55.

The driver 22 includes a first motor 101 and a first wheel train 110, which drive the second hand 3B, a second motor 102 and a second wheel train 120, which drive the minute hand 3C, and a third motor 103 and a third wheel train 130, which drive the hour hand 3D, as shown in FIG. 3.

The driver 22 further includes a fourth motor 104 and a fourth wheel train 140, which drive the indicating hands 791 and 792, a fifth motor 105 and a fifth wheel train 150, which drive the indicating hand 771, and a sixth motor 106 and a sixth wheel train 160, which drive the indicating hand 781. The date indicator 55 may be driven with a dedicated motor that is separately incorporated. In the present embodiment, however, a Geneva mechanism, not shown, is provided in addition to the sixth motor 106 and the sixth wheel train 160, which drive the indicating hand 781, so as to be capable of moving the date indicator 55 by an amount corresponding to one day when the indicating hand 781 rotates by predetermine turns (six turns, for example).

The motors 101 to 106 are each a stepper motor for a timepiece, and only the fourth motor 104 is a two-coil stepper motor having two coils.

Motor Arrangement

The first motor 101 is located in the plan view so as to overlap with the 4-o'clock imaginary line L4 and to be positioned between a winding stem 701 of a changeover apparatus 700 and the indicating hand shaft 4 (plane center O).

The second motor 102 is located in the plan view so as to overlap with the 8-o'clock imaginary line L8 and to be positioned between the secondary battery 24 and the planar antenna 40.

The third motor 103 is disposed in the plan view between the winding stem 701 of the changeover apparatus 700 and the planar antenna 40, more specifically, between the 2-o'clock imaginary line L2 and the planar antenna 40. The third motor 103 is disposed in the plan view so as to partially overlap with the 1-o'clock imaginary line Ll.

The fourth motor 104 is disposed in the plan view between the secondary battery 24 and the winding stem 701 of the changeover apparatus 700 and in a position where the fourth motor 104 overlaps with the 5-o'clock imaginary line L5 and the 6-o'clock imaginary line L6.

The fifth motor 105 is disposed in the plan view so as to partially overlap with the 2-o'clock imaginary line L2 and to be positioned between the winding stem 701 of the changeover apparatus 700 and the third motor 103.

The sixth motor 106 is disposed in the plan view so as to partially overlap with the 10-o'clock imaginary line L10, and the rotor and the coil of the sixth motor 106 are disposed between the 9-o'clock imaginary line L9 and the 10-o'clock imaginary line L10.

The motors 101 to 106 are therefore disposed so as to not overlap with the planar antenna 40, the secondary battery 24, or the winding stem 701 in the plan view.

The indicating hand shaft 5B, to which the indicating hand 771 is attached, the indicating hand shaft 5C, to which the indicating hand 781 is attached, and the indicating hand shaft 5D, to which the indicating hands 791 and 792 are attached, are each disposed in a position inside the inner circumference of the date indicator 55.

The first wheel train 110 includes a second intermediate wheel 111, which engages with a rotor pinion of the first motor 101, a second wheel 112, which engages with a pinion of the second intermediate wheel 111, and a second detection wheel 113, which engages with the pinion of the second intermediate wheel 111. The second hand 3B is attached to the second hand shaft 4B of the second wheel 112.

The second intermediate wheel 111 and the second detection wheel 113 are each provided with a hand position detection hole detected with a hand position detector used in related art and including a light emitter and a light receiver. The second wheel train 120, the third wheel train 130, and the sixth wheel train 160 are each also provided with a gear having a position detection hole and further provided with a position detector according to the position of the hole.

The second wheel train 120 includes a fifth wheel and pinion 121, which engages with a rotor pinion of the second motor 102, a third wheel and pinion 122, which engages with a pinion of the fifth wheel and pinion 121, and a center wheel and pinion 123, which engages with a pinion of the third wheel and pinion 122. The center wheel and pinion 123 is disposed so as to overlap with the second wheel 112 in the plan view. The minute hand 3C is attached to the minute hand shaft 4C of the center wheel and pinion 123.

The third wheel train 130 includes an hour first intermediate wheel 131, which engages with a rotor pinion of the third motor 103, an hour second intermediate wheel 132, which engages with the hour first intermediate wheel 131, an hour third intermediate wheel 133, which engages with the hour second intermediate wheel 132, an hour fourth intermediate wheel 134, which engages with a pinion of the hour third intermediate wheel 133, an hour fifth intermediate wheel 135, which engages with a pinion of the hour fourth intermediate wheel 134, and an hour wheel 136, which engages with a pinion of the hour fifth intermediate wheel 135. The hour wheel 136 is disposed so as to overlap with the second wheel 112 and the center wheel and pinion 123 in the plan view. The hour hand 3D is attached to the hour hand shaft 4D of the hour wheel 136.

An hour detection wheel that is not shown but is disposed on the rear side of the main plate 21 engages with the pinion of the hour fifth intermediate wheel 135.

The fourth wheel train 140 is a wheel train that drives the indicating hands 791 and 792 for the home time (HT), and the fourth wheel train 140 includes an HT intermediate wheel 141, which engages with a rotor pinion of the fourth motor 104, an HT minute wheel and pinion 142, which engages with a pinion of the HT intermediate wheel 141, an HT minute wheel 143, and an HT hour wheel 144, which engages with a pinion of the HT minute wheel 143. The HT hour wheel 144 overlaps with the HT minute wheel and pinion 142 in the plan view and is disposed on the rear side of the main plate 21.

The indicating hand 791, which is the minute hand for HT, is attached to the HT minute wheel and pinion 142, and the indicating hand 792, which is the hour hand for HT, is attached to the HT hour wheel 144.

That is, the fourth motor 104 drives the indicating hands 791 and 792 attached to the second indicating hand shaft 5D provided in the 6-o'clock direction with respect to the indicating hand shaft 4 (plane center O of dial 50).

The fifth wheel train 150 is a wheel train that drives the indicating hand 771, which is provided in a 3-o'clock position and is a day hand indicating the day, and includes a small day second intermediate wheel 151, which engages with a rotor pinion of the fifth motor 105, a small day second intermediate wheel 152, which engages with a pinion of the small day first intermediate wheel 151, and a small day wheel 153, which engages with a pinion of the small day second intermediate wheel 152. The small day wheel 153 is disposed on the rear side of the main plate 21, and the indicating hand 771 is attached to the indicating hand shaft 5B of the small day wheel 153.

The small day wheel 153 can be selectively disposed at two locations, that is, in a position where the small day wheel 153 partially overlaps with the 3-o'clock imaginary line L3 and in a position where the small day wheel 153 partially overlaps with the 2-o'clock imaginary line L2 in the plan view. That is, the fifth motor 105 drives the indicating hand 771 attached to the third indicating hand shaft 5B provided in the range from the 3-o'clock direction to the 2-o'clock direction with respect to the indicating hand shaft 4 (plane center O of dial 50).

In the first electronic timepiece 1, the small day wheel 153 is located so as to overlap with the 3-o'clock imaginary line L3 in the plan view. Specifically, the small day wheel 153 is located so that the line that connects the position of the indicating hand shaft 5B of the small day wheel 153 to the indicating hand shaft 4 (plane center O of dial 50) intersects the 3-o'clock imaginary line L3 at an angle ranging from about 4 to 8 degrees, for example, about 6 degrees.

The sixth wheel train 160 is a wheel train that is provided in a 9-o'clock position and drives the indicating hand 718, which is the mode hand (MI) indicating mode information and other pieces of information, and the sixth wheel train 160 includes an MI first intermediate wheel 161, which engages with a rotor pinion of the sixth motor 106, an MI second intermediate wheel 162, which engages with the MI first intermediate wheel 161, and an MI wheel 163, which engages with a pinion of the MI second intermediate wheel 162. The indicating hand 781 is attached to the indicating hand shaft 5C of the MI wheel 163.

The MI second intermediate wheel 162 and the MI wheel 163 can each be selectively disposed at two locations, that is, in a position where the MI second intermediate wheel 162 or the MI wheel 163 partially overlaps with the 9-o'clock imaginary line L9 and in a position where the MI second intermediate wheel 162 or the MI wheel 163 partially overlaps with the 10-o'clock imaginary line L10 in the plan view. That is, the sixth motor 106 drives the indicating hand 781 attached to the fourth indicating hand shaft 5C provided in the range from the 9-o'clock direction to the 10-o'clock direction with respect to the indicating hand shaft 4 (plane center O of dial 50).

In the first electronic timepiece 1, the MI second intermediate wheel 162 and the MI wheel 163 are located so as to overlap with the 9-o'clock imaginary line L9 in the plan view. Specifically, the MI second intermediate wheel 162 and the MI wheel 163 are located so that the line that connects the position of the indicating hand shaft 5C of the MI wheel 163 to the indicating hand shaft 4 (plane center O of dial 50) intersects the 9-o'clock imaginary line L9 at an angle ranging from about 4 to 8 degrees, for example, about 6 degrees.

Changeover Apparatus

The changeover apparatus 700 is an apparatus that acts in synchronization with the operation of the crown 6 and is a typical changeover mechanism including a setting lever, a yoke, a click spring, a switch lever, a setting lever spring, a switch contact spring element, a switch contact spring, a switch wheel, and other components in addition to the winding stem 701, to which the crown 6 is attached.

The winding stem 701 is provided in the movement 20 in a 3-o'clock position on the dial 50 in the plan view, as shown in FIG. 3. Further, the changeover apparatus 700 including the setting lever and other components in addition to the winding stem 701 is disposed so as to extend from the 3-o'clock imaginary line L3 to the 4-o'clock imaginary line L4 along the outer circumference of the dial 50.

Although not shown, a circuit presser, an antimagnetic plate, the circuit substrate, an antenna presser, the train wheel bridge, and other components are disposed on the front side of the main plate 21 in addition to the components described above.

Although not shown, an hour wheel presser, an antimagnetic plate, a date indicator maintaining plate, and other components are disposed on the rear side of the main plate 21 in addition to the date indicator 55, the solar cell panel 25, the dial 50 or 50B, and other components described above. These components have been used in related art and will therefore not be described.

Second Electronic Timepiece

The electronic timepiece 1B, which differs from the electronic timepiece 1 in that the positions of the first small window 770 and the second small window 780 in the plan view are changed, will be described next with reference to FIGS. 4 and 5.

Figure 5:
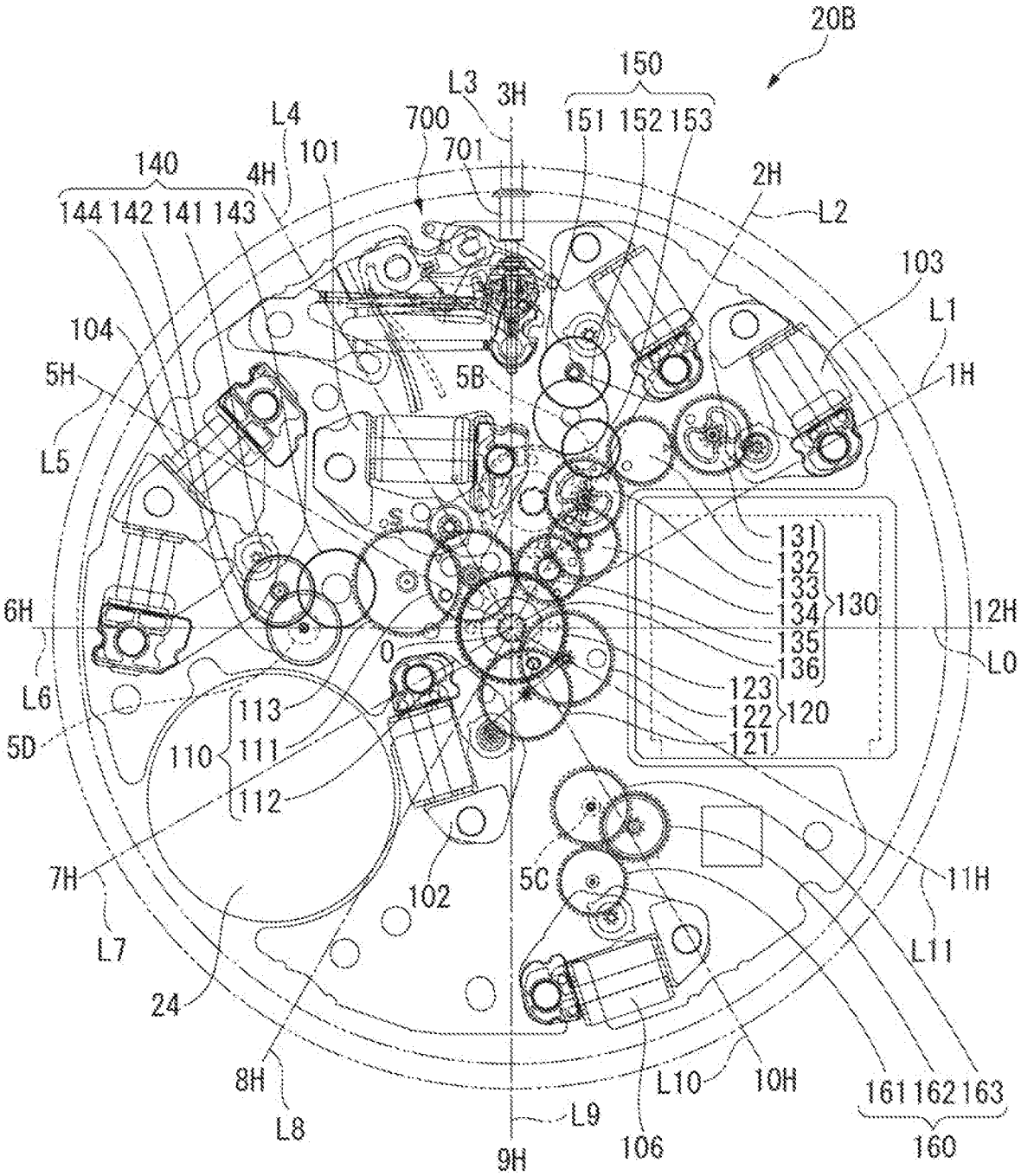
FIG. 5 is a plan view showing a movement of the second electronic timepiece.

In the electronic timepiece 1B, the position of the indicating hand shaft 5B of the indicating hand 771 in the first small window 770 is moved toward the 2-o'clock side as compared with the position as in the electronic timepiece 1 and the position of the indicating hand shaft 5C of the indicating hand 781 in the second small window 780 is moved toward the 10-o'clock side as compared with the position as in the electronic timepiece 1, as shown in FIGS. 4 and 5.

Specifically, the indicating hand shaft 5B of the indicating hand 771 is disposed so as to be slightly shifted from the 2-o'clock imaginary line L2 toward the 3-o'clock imaginary line L3 and further located so that the line that connects the indicating hand shaft 5B to the plane center O intersects the 2-o'clock imaginary line L2 at an angle ranging from about 4 to 8 degrees, for example, about 6 degrees.

Similarly, the indicating hand shaft 5C of the indicating hand 781 is also disposed so as to be slightly shifted from the 10-o'clock imaginary line L10 toward the 9-o'clock imaginary line L9 and further located so that the line that connects the indicating hand shaft 5C to the plane center O intersects the 10-o'clock imaginary line L10 at an angle ranging from about 4 to 8 degrees, for example, about 6 degrees.

To achieve the above-mentioned positions of the indicating hand shafts 5B and 5C, in the fifth wheel train 150 associated with the fifth motor 105 in a movement 20B of the electronic timepiece 1B, the small day first intermediate wheel 151 and the small day second intermediate wheel 152 are disposed in the same positions as in the electronic timepiece 1, as shown in FIG. 5. On the other hand, the small day wheel 153 is disposed in a position shifted from the small day second intermediate wheel 152 toward the 2-o'clock imaginary line L2.

Further, in the sixth wheel train 160 associated with the sixth motor 106 in the electronic timepiece 1B, the MI first intermediate wheel 162 is disposed in the same position as in the electronic timepiece 1. On the other hand, the MI second intermediate wheel 162 and the MI wheel 163 are disposed in positions shifted from the MI first intermediate wheel 161 toward the 10-o'clock imaginary line L10.

The main plate 21 and the wheel train bridge, which support the gears of the fifth wheel train 150 and the sixth wheel train 160, are therefore configured so that the small day wheel 153, the MI second intermediate wheel 162, and the MI wheel 163 can be selectively disposed in two different positions, that is, positions for the electronic timepiece 1 and positions for the electronic timepiece 1B. Further, a dial 50B of the electronic timepiece 1B differs from the dial 50 of the electronic timepiece 1 with respect to the positions of the first small window 770 and the second small window 780. Moreover, on the rear side of the main plate 21, the parts into which the indicating hand shafts 5B and 5C are inserted (such as date pressor and solar panel) are provided with through holes into which the indicating hand shafts 5B and 5C can be inserted. The other components of the electronic timepiece 1B are the same as those of the electronic timepiece 1 and will therefore not be described.

Advantageous Effects Provided by Embodiment

In the electronic timepieces 1 and 1B, the planar antenna 40 is located so as to overlap with the 12-o'clock imaginary line L0 in the plan view, the winding stem 701 is located so as to overlap with the 3-o'clock imaginary line L3 in the plan view, the secondary battery 24 is located so as to overlap with the 7-o'clock imaginary line L7 in the plan view, and the planar antenna 40, the winding stem 701, and the secondary battery 24 are disposed so as to not overlap with one another in the plan view. The thickness of each of the electronic timepieces 1 and 1B can therefore be reduced as compared with the case where the antenna, the winding stem, and the battery overlap with one another in the plan view.

Further, the motors 101 to 106 are disposed not only so as to not overlap with one another in the plan view but also so as to not overlap with any of the planar antenna 40, the winding stem 701, and the secondary battery 24 in the plan view. The thickness of each of the electronic timepieces 1 and 1B can therefore be reduced as compared with the case where the motors 101 to 106 overlap with the secondary battery 24 and other components.

In the space that overlaps with the dial 50 in the plan view, the planar antenna 40 is disposed on the 12-o'clock side of the dial 50, the winding stem 701 is disposed on the 3-o'clock side of the dial 50, and the secondary battery 24 is disposed in a region shifted from the 3-o'clock imaginary line L3 and the 9-o'clock imaginary line L9 toward the 6-o'clock side, specifically, toward the 7-o'clock side. Each part having a relatively large area can therefore be disposed in a distributed manner in each of the movements 20 and 20B. Further, the third motor 103 is disposed in the narrow space between the planar antenna 40 and the winding stem 701. The layouts described above allow an increase in the flexibility of the layout of the small windows 770, 780, and 790, whereby timepieces having assorted exterior appearances can be provided. The indicating hands 771, 781, 791, and 792 provided in the small windows 770, 780, and 790 can be used to perform a chronograph function and dual time display and even display values measured with a variety of sensors and other components, whereby the applications of the timepieces 1 and 1B can be readily expanded to multifunctional products.

Since the first motor 101, which drives the second hand 3B, the second motor 102, which drives the minute hand 3C, and the third motor 103, which drives the hour hand 3D, are provided independently of one another, the secondhand 3B, the minute hand 3C, and the hour hand 3D can be driven independently of one another. Therefore, to correct the time based on signals received via the planar antenna 40, the time can be corrected in a short period of time with the travel of each of the second hand 3B, the minute hand 3C, and the hour hand 3D minimized, whereby the convenience provided by the timepiece can be improved.

The motors 101 to 103, which drive the second hand 3B, the minute hand 3C, and the hour hand 3D, which are center hands, are preferably disposed in a central portion of each of the movements 20 and 20B. However, since the planar antenna 40 and the secondary battery 24, which each occupy a relatively large area, are also disposed in the movement, the three motors 101 to 103 cannot be disposed in the central portion of each of the movements 20 and 20B. To solve this problem, in the present embodiment, the third motor 103 is disposed between the planar antenna 40 and the winding stem 701, specifically, by using the space bordered by the 1-o'clock imaginary line L1 and the 2-o'clock imaginary line L2. The other motors 101 and 102 can therefore each be disposed in an appropriate position in the central portion of each of the movements 20 and 20B, and the second hand 3B, the minute hand 3C, and the hour hand 3D can be driven independently of one another, so that an efficient layout can be achieved, and the planar area of each of the movements 20 and 20B can be reduced, whereby the size of each of the electronic timepieces 1 and 1B can be reduced.

In the exterior enclosure 10, out of the two regions separated by the 3-o'clock imaginary line L3 and the 9-o'clock imaginary line L9, the planar antenna 40 is disposed in the 12-o'clock-side region, and the secondary battery 24 is disposed in the 6-o'clock-side region, whereby the planar antenna 40 can be disposed so as to be separate from the secondary battery 24. The negative effect of the secondary battery 24, which is made of a metal, on the reception performed by the planar antenna 40 can therefore be reduced, whereby the reception performance of the planar antenna 40 can be improved.

Out of the three motors 101 to 103, which drive the second hand 3B, the minute hand 3C, and the hour hand 3D, the third motor 103, which drives the hour hand 3D, is disposed so as to be closest to the planar antenna 40. Therefore, when the planar antenna 40 performs reception with the second hand 3B, the minute hand 3C, and the hour hand 3D moving, the effect of the action of each of the motors 101 to 103 on the reception can be minimized. That is, out of the secondhand 3B, the minute hand 3C, and the hour hand 3D, the hour hand 3D moves at the longest interval, and the third motor 103 also acts at an interval longer than intervals at which the other motors 101 and 102 act. For example, the first motor 101 moves at an interval of one second, the second motor 102 moves at an interval of five seconds, and the third motor 103 moves at an interval of sixty seconds. The third motor 103 therefore affects the reception performance of the planar antenna 40 less than the other motors 101 and 102. Since the third motor 103 can therefore be disposed in a position close to the planar antenna 40, the planar area of each of the electronic timepieces 1 and 1B and hence the size thereof can be reduced.

Further, the third motor 103 acts at an interval longer than intervals at which the other motors 101 and 102 act. Therefore, even when the energy carried by a drive signal that drives the third motor 103 is increased, an increase in power consumption can be suppressed. The number of gears in the third wheel train 130 can therefore be increased as compared with the number of gears in each of the first wheel train 110 and the second wheel train 120, whereby the third wheel train 130 can be disposed in a position close to the outer circumference of the dial 50 or in a position separate from the indicating hand shaft 4. Since the third motor 130 can therefore be disposed in the space between the planar antenna 40 and the winding stem 701, the space efficiency in each of the electronic timepieces 1 and 1B can be improved, whereby the size of each of the electronic timepieces 1 and 1B can be reduced.

Since the changeover apparatus 700 including the winding stem 701 is disposed along the outer circumference of the dial 50 and in the space from the 3-o'clock imaginary line L3 to the 4-o'clock imaginary line L4, a space can be provided between the winding stem 701 (changeover apparatus 700) and the third motor 103, and the fifth motor 105, which drives the indicating hand 771, can be disposed in the space. The third motor 103, the third wheel train 130, the fifth motor 105, and the fifth wheel train 150 can therefore be disposed in the fan-shaped region bordered by the 1-o'clock imaginary line L1 and the 3-o'clock imaginary line L3. Therefore, the space where the other motors 101, 102, 104, and 106 are disposed can be enlarged, and the flexibility of the sub-dial arrangement can be improved, whereby a multifunctional timepiece provided with a plurality of indicating hands can be readily achieved.

Further, the fifth motor 105, which drives the indicating hand 771 in the first small window 770, which is disposed in the 2-o'clock or 3-o'clock position, can be disposed in a position close to the indicating hand shaft 5B for the indicating hand 771. The number of gears in the fifth wheel train 150 can therefore be minimized, whereby the driving efficiency can also be improved.

Since the changeover apparatus 700 is disposed along the outer circumference of the dial 50, a space can be provided between the changeover apparatus 700 and the indicating hand shaft 4, whereby the first motor can be disposed in the space. Therefore, the first motor 101 can be disposed so as to be close to the indicating hand shaft 4, and the first wheel train 110, which drives the second hand 3B, can be formed only of minimum gears, whereby the first motor 101 and the first wheel train 110 can be efficiently disposed.

Since the planar antenna 40 is disposed in the 12-o'clock position, and the secondary battery 24 is disposed in the 7-o'clock position, a space can be provided between the secondary battery 24 and the planar antenna 40, whereby the second motor 102 can be disposed in the space. Therefore, the second motor 102 can be disposed so as to be close to the indicating hand shaft 4, and the second wheel train 120, which drives the minute hand 3C, can be formed only of minimum gears, whereby the second motor 102 and the second wheel train 120 can be efficiently disposed.

Since the secondary battery 24 is disposed in the 7-o'clock position, a large space can be disposed between the changeover apparatus 700 and the secondary battery 24 along the outer circumference of the dial 50, whereby the fourth motor 104, which is larger than the other motors, can be disposed in the large space. The high-speed motor can therefore be disposed with no increase in the outer diameter of each of the electronic timepieces 1 and 1B.

Since the fourth motor 104 is a high-speed motor having two coils, the indicating hands 791 and 792 can be moved at high speed. Therefore, to change the time zone of the home time or to swap the local time indicated with the minute hand 3C and the hour hand 3D for the home time and vice versa, the indicating hands 791 and 792 can be corrected in a short period.

Since the motors 101 to 105, the secondary battery 24, and the planar antenna 40 are disposed in a region other than the region between the 9-o'clock imaginary line L9 and the 11-o'clock imaginary line L11, the sixth motor 106 can be disposed in the region between the 9-o'clock imaginary line L9 and the 11-o'clock imaginary line L11. The sixth motor 106, which drives the indicating hand 781 in the second small window 780, which is disposed in the 9-o'clock or 10-o'clock position, can be disposed in a position close to the indicating hand shaft 5C for the indicating hand 781. Therefore, the number of gears in the sixth wheel train 160 can be minimized, and the driving efficiency can also be improved. Further, a space for an additional gear for detection can be provided, and the position indicated by the indicating hand 781, which is the mode hand and used to display the remaining power of the battery, can be appropriately controlled. Moreover, to rotate the date indicator 55 by using the Geneva mechanism that is not shown but acts in synchronization with the sixth wheel train 160, the number of revolutions of the gear for detection can be detected, whereby the movement of the date indicator 55 can also be accurately controlled.

Other Embodiments

The present disclosure is not limited to the embodiments described above, and a variety of variations are conceivable.

In another embodiment of the invention, the number of motors is not limited to the number in the embodiments described above, and at least three independent motors that drive the second hand 3B, the minute hand 3C, and the hour hand 3D may be provided.

The arrangement of the motors 101 to 103 is not limited to the arrangement in the embodiments described above. For example, the first motor 101 and the second motor 102 may be disposed between the planar antenna 40 and the winding stem 701. The first motor 101 and the third motor 103 may be disposed between the planar antenna 40 and the secondary battery 24. The second motor 102 and the third motor 103 may be disposed between the indicating hand shaft 4, which is provided at the plane center O of each of the dials 50 and 50B, and the winding stem 701.

The planar antenna 40 may be located so as to at least partially overlap with the 12-o'clock imaginary line L0. For example, the planar antenna 40 may be located so that the plane center thereof overlaps with the 11-o'clock imaginary line L11. The orientation of the disposed planar antenna 40 is not limited to the orientation in the embodiments described above.

The secondary battery 24 may be disposed in a region shifted from the 3-o'clock imaginary line L3 and the 9-o'clock imaginary line L9 toward the 6-o'clock side. For example, the secondary battery 24 may be located so as to overlap with the 5-o'clock imaginary line L5 or the 8-o'clock imaginary line L8.

The fourth motor 104 may be disposed in accordance with the position where the secondary battery 24 is disposed. For example, in the case where the secondary battery 24 is located so as to overlap with the 5-o'clock imaginary line L5, the fourth motor 104 may be disposed between the secondary battery 24 and the 9-o'clock imaginary line L9.

Further, the fourth motor 104 is not limited to a two-coil motor and may instead be a one-coil motor like the other motors. Moreover, since the sixth motor 106 is disposed in a relatively large space, two indicating hands may be provided in the second small window 780, and the sixth motor 106 may be formed of a two-coil motor to display the home time in the second small window 780.

That is, the information displayed in each of the first small window 770, the second small window 780, and the third small window 790 is not limited to the information in the embodiments described above and may be set in accordance with the function achieved in each of the electronic timepieces 1 and 1B.

The signals received via the planar antenna 40 are not each limited to a satellite signal transmitted from a GPS satellite, which is a position information satellite. For example, the satellite signals may each instead be a signal transmitted from a satellite used in GALILEO (EU), GLONASS (Russia), Beidou (China), or any other global navigation satellite system (GNSS). The satellite signals may each still instead be a satellite signal transmitted from a satellite-based augmentation system (SBAS) or any other stationary satellite, a satellite used in a global satellite positioning system (RNSS) that allows searching only in a specific area, such as a quasi-zenith satellite, and any other satellite. Further, the planar antenna 40 may instead have specifications that allow reception of a signal other than a satellite signal.

The planar antenna 40 is not limited to the patch antenna described above and may instead be a chip antenna or any other type of planar antenna, and an appropriate planar antenna may be used in accordance with the type of signal to be received. The battery is not limited to the secondary battery 24 and may instead be a primary battery.

The entire disclosure of Japanese Patent Application No. 2018-029745 filed Feb. 22, 2018 is expressly incorporated herein by reference.

What is claimed is:

1. An electronic timepiece comprising:

a dial;

an indicating hand shaft which passes through the dial;

an hour hand attached to the indicating hand shaft;

a planar antenna located so as to overlap with a 12-o'clock imaginary line that connects the indicating hand shaft to a 12-o'clock position in a plan view;

a winding stem located so as to overlap with a 3-o'clock imaginary line that connects the indicating hand shaft to a 3-o'clock position in the plan view;

a battery entirely disposed in a first region defined by dividing the dial in the plan view by a 9-o'clock imaginary line that connects the indicating hand shaft to a 9-o'clock position and the 3-o'clock imaginary line and includes a 6-o'clock position on the dial; and a first motor that drives a second hand, a second motor that drives a minute hand, and a third motor that drives the hour hand, wherein the planar antenna, the winding stem, the battery, the first motor, the second motor, and the third motor are located so as to not overlap with one another in the plan view, and one of the first motor, the second motor, and the third motor is disposed between the planar antenna and the winding stem.

2. The electronic timepiece according to claim 1, wherein one of the first motor, the second motor, and the third motor is disposed between the indicating hand shaft and the winding stem in the plan view.

3. The electronic timepiece according to claim 1, wherein one of the first motor, the second motor, and the third motor is disposed between the planar antenna and the battery in the plan view.

4. The electronic timepiece according to claim 1, wherein the motor disposed between the planar antenna and the winding stem is the third motor.

5. The electronic timepiece according to claim 1, wherein a fourth motor is disposed between the battery and the winding stem, and the fourth motor drives an indicating hand attached to a second indicating hand shaft provided in a position shifted from the indicating hand shaft in a 6-o'clock direction.

6. The electronic timepiece according to claim 1, wherein one of the first motor, the second motor, and the third motor and another motor are disposed between the planar antenna and the winding stem, and the another motor drives an indicating hand attached to another indicating hand shaft provided in a range from a 3-o'clock direction to a 2-o'clock direction with respect to the indicating hand shaft.

7. The electronic timepiece according to claim 1, wherein another motor is disposed between the planar antenna and the 9-o'clock imaginary line, and the another motor drives an indicating hand attached to another indicating hand shaft provided in a range from a 9-o'clock direction to a 10-o'clock direction with respect to the indicating hand shaft.

8. An electronic timepiece comprising:

a dial;

a planar antenna overlapping a 12-o'clock imaginary line of the dial;

a winding stem overlapping a 3-o'clock imaginary line of the dial;

a battery disposed in a region of the dial bordered by a 9-o'clock to 3-o'clock imaginary line and including the 6-o'clock position on the dial; and a first motor driving a second hand, a second motor driving a minute hand, and a third motor driving an hour hand, wherein the planar antenna, the winding stem, the battery, the first motor, the second motor, and the third motor are circumferentially spaced apart from one another in a plan view, and one of the first, second, and third motor is disposed between the planar antenna and the winding stem.

9. The electronic timepiece according to claim 8, further comprising:

an indicating hand shaft passing through the dial to which the hour hand is attached.

10. The electronic timepiece according to claim 9, wherein one of the first motor, the second motor, and the third motor is disposed between the indicating hand shaft and the winding stem in the plan view.

11. The electronic timepiece according to claim 8, wherein one of the first motor, the second motor, and the third motor is disposed between the planar antenna and the battery in the plan view.

12. The electronic timepiece according to claim 8, wherein the motor disposed between the planar antenna and the winding stem is the third motor.

13. The electronic timepiece according to claim 8, wherein a fourth motor is disposed between the battery and the winding stem, and the fourth motor drives an indicating hand attached to an indicating hand shaft provided in a position shifted in a 6-o'clock direction.

14. The electronic timepiece according to claim 8, wherein one of the first motor, the second motor, and the third motor and another motor are disposed between the planar antenna and the winding stem, and the another motor drives an indicating hand attached to an indicating hand shaft provided in a range from a 3-o'clock direction to a 2-o'clock direction.

15. The electronic timepiece according to claim 8, wherein another motor is disposed between the planar antenna and a 9-o'clock imaginary line of the dial, and the another motor drives an indicating hand attached to an indicating hand shaft provided in a range from a 9-o'clock direction to a 10-o'clock direction.

16. An electronic timepiece comprising:

a dial;

a planar antenna overlapping a 12-o'clock radius of the dial;

an indicating hand shaft passing through the dial;

an hour hand attached to the indicating hand shaft;

a winding stem overlapping a 3-o'clock radius of the dial;

a battery disposed in a semicircular region of the dial bordered by a 9-o'clock to 3-o'clock diameter of the dial and including the 6-o'clock position on the dial; and a first motor driving a second hand, a second motor driving a minute hand, and a third motor driving the hour hand, wherein the planar antenna, the winding stem, the battery, the first motor, the second motor, and the third motor are disposed in different discrete sectors of the dial, and one of the first, second, and third motor is disposed between the planar antenna and the winding stem.

17. The electronic timepiece according to claim 16, wherein the motor disposed between the planar antenna and the winding stem is the third motor.

18. The electronic timepiece according to claim 16, wherein a fourth motor is disposed between the battery and the winding stem, and the fourth motor drives an indicating hand attached to a second indicating hand shaft provided in a position shifted from the indicating hand shaft in a 6-o'clock direction.

19. The electronic timepiece according to claim 16, wherein one of the first motor, the second motor, and the third motor and another motor are disposed between the planar antenna and the winding stem, and the another motor drives an indicating hand attached to another indicating hand shaft provided in a sector bordered by a 3-o'clock radius and a 2-o'clock radius.

20. The electronic timepiece according to claim 16, wherein another motor is disposed between the planar antenna and the 9-o'clock radius, and the another motor drives an indicating hand attached to another indicating hand shaft provided in a sector bordered by the 9-o'clock radius and a 10-o'clock radius.

* * * * *